United States Patent [19]

Matsuo et al.

[11] Patent Number: 5,050,860

[45] Date of Patent: Sep. 24, 1991

[54] SHEET SORTER

[75] Inventors: Kazuhiro Matsuo, Tokyo; Kimiaki Hayakawa, Yokohama, both of Japan

[73] Assignee: Canon Kabushiki Kaisha, Tokyo, Japan

[21] Appl. No.: 656,029

[22] Filed: Feb. 15, 1991

Related U.S. Application Data

[63] Continuation of Ser. No. 304,486, Feb. 1, 1989, abandoned.

[30] Foreign Application Priority Data

| | | | |
|---|---|---|---|
| Feb. 2, 1988 | [JP] | Japan | 63-21370 |
| Feb. 4, 1988 | [JP] | Japan | 63-22831 |
| Feb. 8, 1988 | [JP] | Japan | 63-25708 |

[51] Int. Cl.[5] ..... B65H 31/24

[52] U.S. Cl. ..... 271/293; 271/294; 271/301

[58] Field of Search ..... 271/291-294, 271/296, 301, 902, 288, 289, 290

[56] References Cited

U.S. PATENT DOCUMENTS

| | | | |
|---|---|---|---|
| 4,017,173 | 4/1977 | Komori et al. . | |
| 4,607,838 | 8/1986 | Matsuyama | 271/294 X |
| 4,709,915 | 12/1987 | Ishikawa et al. . | |
| 4,761,001 | 8/1988 | Hayakawa | 271/902 X |
| 4,787,616 | 11/1988 | Sasaki | 271/294 X |

FOREIGN PATENT DOCUMENTS 58-183566 10/1983 Japan .

*Primary Examiner*—Richard A. Schacher

*Attorney, Agent, or Firm*—Fitzpatrick, Cella, Harper & Scinto

[57] ABSTRACT

A sheet sorter includes a plurality of bin trays in the form of multi-stage; a plurality of followers adjacent sheet receiving sides of the bin trays; a rotatable screw for sequentially moving the followers to expand a gap between adjacent bin trays; and wherein accommodating portion disposed at both sides of the sheet receiving side of the sheet sorter to accommodate the rotatable screw, a connecting portion for connecting the accommodating portions and a member for defining a groove for guiding movements of the plurality of followers, are integrally molded.

14 Claims, 7 Drawing Sheets

SHEET SORTER

This application is a continuation of application Ser. No. 304,486 filed Feb. 1, 1989, now abandoned.

FIELD OF THE INVENTION AND RELATED ART

The present invention relates to a sheet sorter for sequentially receiving and sorting sheets such as documents or prints discharged from an image forming apparatus such as copying machine, printer and facsimile, onto bin trays.

In a conventional sheet sorter for receiving and sorting original documents or copy sheets which will hereinafter be called "sheets" discharged from a copying machine, for example, lateral side plates disposed at opposite sides of the sheet inlet, a connecting plate for connecting the side plates and members defining guiding slots or grooves for guiding vertical movement of followers, are constructed by separate members, and those members are coupled by fixing means such as screws or the like. The side plates are provided with grooves for guiding the followers, and accommodate lead cams for guiding the followers for expanding the space between adjacent bin trays (Japanese Laid-Open Patent Application 183566/1983).

Since in the conventional sorter, the side plates disposed at both sides of the sheet inlet and accommodating the lead cams, the connecting plate for connecting those side plates and the guiding groove for guiding the follower are constituted by separate members, it involves the problems that the number of parts is increased, that the number of assembling operations is increased. Therefore, there is a liability that the assembling accuracy is degraded.

Some conventional type of copying machines are capable of forming superimposed images on the same side of one transfer sheet and/or images on both sides of one transfer sheet. In such a type of copying machines, the transfer sheet is required to be discharged temporarily for the purpose of switching the direction of the conveyance. In this case, it is usual that rotation of discharging rollers of the copying machine is reversed (U.S. Pat. No. 4,017,173, FIG. 7). Where, however, the copying machine is equipped with a sheet sorter for sorting the transfer sheet (which will hereinafter be called "sheet") continuously discharged from the copying machine, a reverse pass mechanism comprising a flapper for reversing the sheet and a guide or space for temporarily accommodating the sheet is added in addition to the sorter, since otherwise the speed controls for both of the discharging rollers of the copying machine and the conveying rollers of the sorter is difficult. In this structure, the sheet tentatively discharged from the copying machine is not directed to discharging rollers of the sorter but is directed to the reverse pass.

In such a conventional structure, the copying machine is required to be equipped, in addition to the sorter, with the reverse passage mechanism including the flapper or sheet guide or the space for temporarily accommodating the sheet, with the result of cumbersome mounting of the reverse passage mechanism and of the bulkiness of the apparatus with the increased cost.

SUMMARY OF THE INVENTION

Accordingly, it is a principal object of the present invention to provide a sheet sorter wherein the number of parts is reduced, and the number of assembling operations is reduced together with increased assembling accuracy.

According to an embodiment of the present invention, there is provided a sheet sorter including multistage bin trays, plural followers mounted to respective leading edges of the bin trays and means for sequentially moving the followers to expand the space between adjacent bin trays, wherein accommodating portions disposed at both lateral sides of the sheet inlet and accommodating the means for moving the followers, and a connecting portion for connecting these accommodating portions and guiding grooves or slots for guiding the movement of the followers are integral formed.

In this embodiment, the accommodating portions, the connecting portion and the members constituting the guiding slots or grooves are integrally formed, and therefore, the necessity for connecting them by screws is eliminated, and in addition, the assembling becomes more accurate with the advantages of a less number of parts and less number of assembling operations.

It is another object of the present invention to provide a sheet sorter which, does not require to be provided with a sheet reversing passage mechanism even when it is used with an image forming apparatus which is capable of superimposing copy and/or duplex copy wherein a sheet is tentatively discharged to switch the conveying direction thereof. By this, the size of the total system is not increased.

According to an embodiment of the present invention, there is provided a sheet sorter for sorting sequentially sorting the sheets continuously discharged from the image forming machine, into bin trays, wherein switching means for switching the conveyance passage of the sheet is disposed upstream of a sheet discharge outlet to the bin trays with respect to sheet conveyance direction, so as to lead the sheets to the sheet discharge outlet upon non-switching of the conveyance passage and to lead the sheets to the guiding slot upon the switching.

In this embodiment, even if the sorter is used with an image forming apparatus capable of superimposing and/or duplex image forming operations wherein a sheet is tentatively discharged therefrom for plural image forming processing on one and the same sheet, it is not required that the switching means and/or the guiding groove is added. Therefore, the size and the cost of the total system are not increased, and the utility thereof is remarkably increased.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
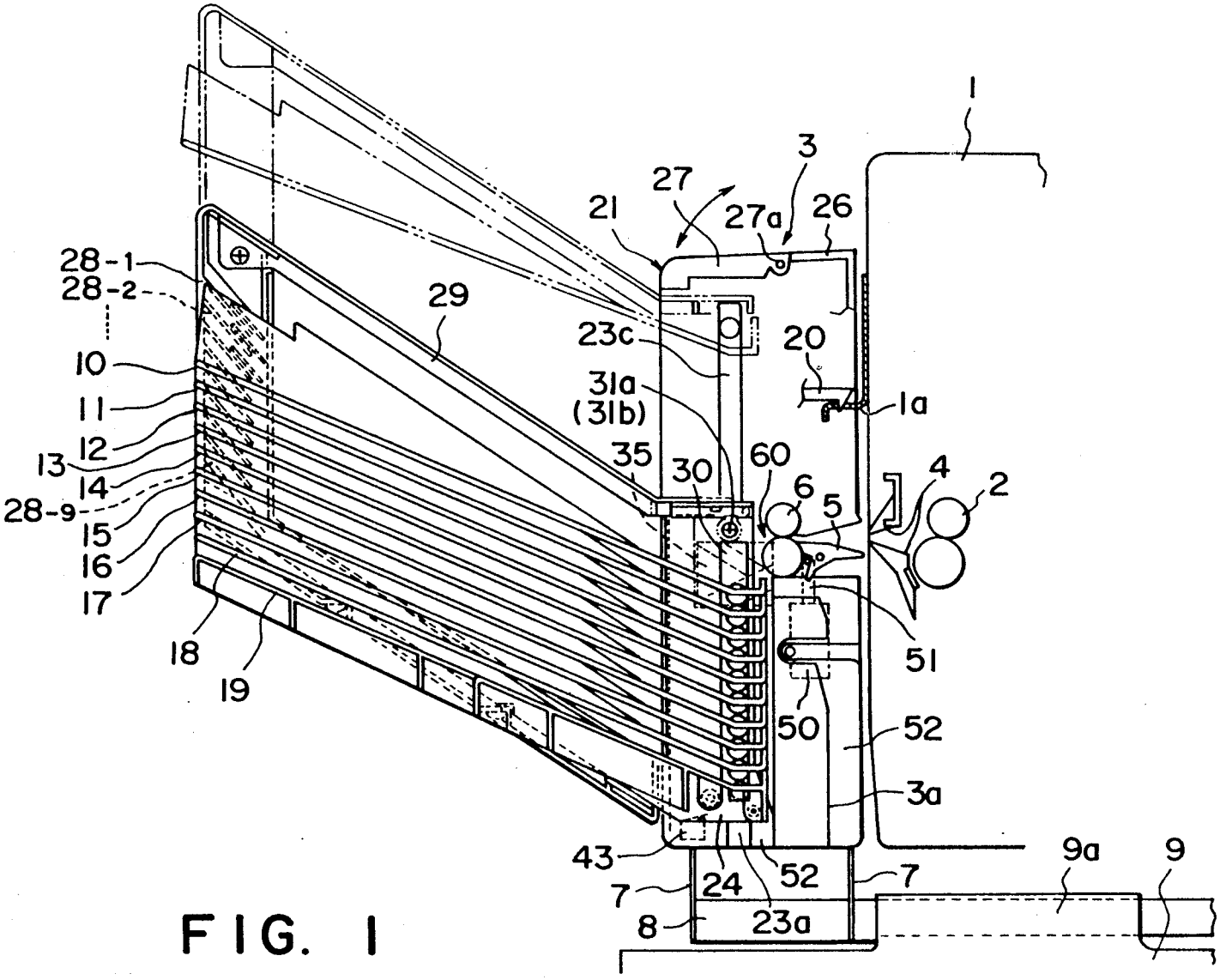
FIG. 1 is a sectional view of a sorter according to an embodiment of the present invention.

Referring to FIG. 1, there is shown a sheet sorter according to an embodiment of the present invention. The sheets continuously discharged from a copying machine 1 by a pair of discharging rollers 2 of the copying machine 1 are transported to and received by bin trays 10–19 by a pair of conveying rollers 6 through an inlet guide of the main assembly 3 of the sorter which is opposed to the pair of discharging rollers 2 and through a switching means in the form of a flapper 5. The pair of conveying rollers 6 are rotated by an unshown driving motor when the bin tray is not moved. The trailing edges (the edges remote from the sheet inlet) of the plural bin trays 10–18 arranged in the form of stages, are supported by supporting portions 28-1–28-9 of a supporting frame which also functions as the bottommost bin tray 19, and the trailing edges of the bin trays 10–19 are slidably stacked. Because the bottommost bin tray 19 also functions as a supporting frame, it is not necessary to support the bin trays 10–19 by a separate and additional supporting arm or the like, and therefore, the number of parts is reduced together with reduction of the size and the weight of the sorter.

The main assembly 3 of the sorter is provided, at its bottom portion, with a channel member 7 having a channel like cross-section, as shown in FIG. 1. To the channel 7, a moving rod 8 is mounted. The moving rod 8 is movably mountable on an upper guide 9*a* of a base 9 bearing the copying machine 1. Upon mounting the main assembly 3 of the sorter to the copying machine, the moving rod 8 is moved along the top guide 9*a* so as to engage a hook 20 of the main assembly 3 with a hole of the engagement portion 1*a* of the copying machine. By this, the mounting is completed. When the main assembly 3 is to be dismounted from the copying machine 1, the hook 20 is disengaged from the hole of the engagement portion 1*a*, and the main assembly 3 of the sorter is pulled horizontally.

Figure 2:
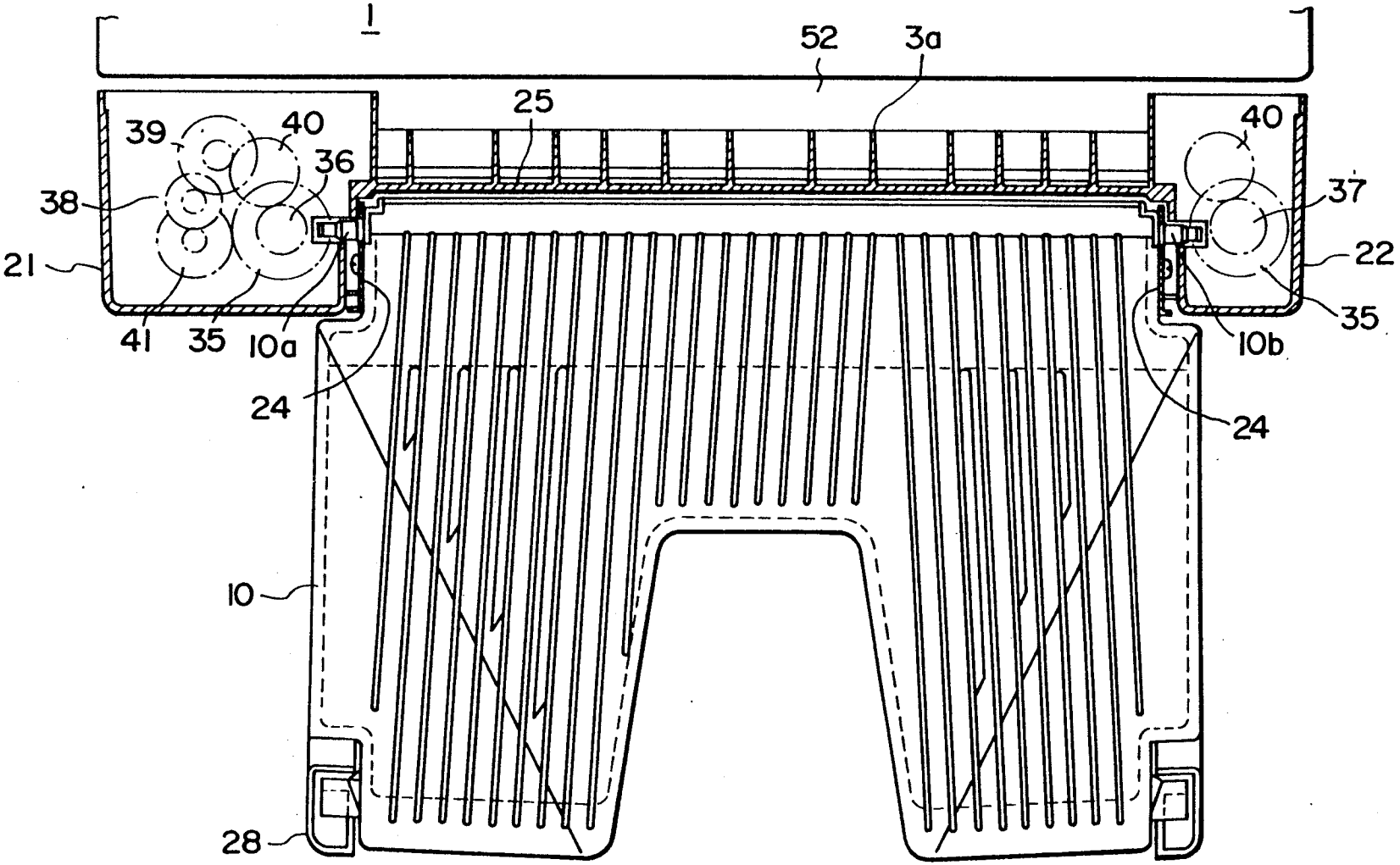
FIG. 2 is another sectional view of the sheet sorter of FIG. 1.

The sorter main assembly 3 is provided with post 21 and 22 at the sheet inlet side and at both lateral sides, as shown in FIG. 2. The posts function as accommodating portions for accommodating elements which will be described hereinafter.

Figure 3:
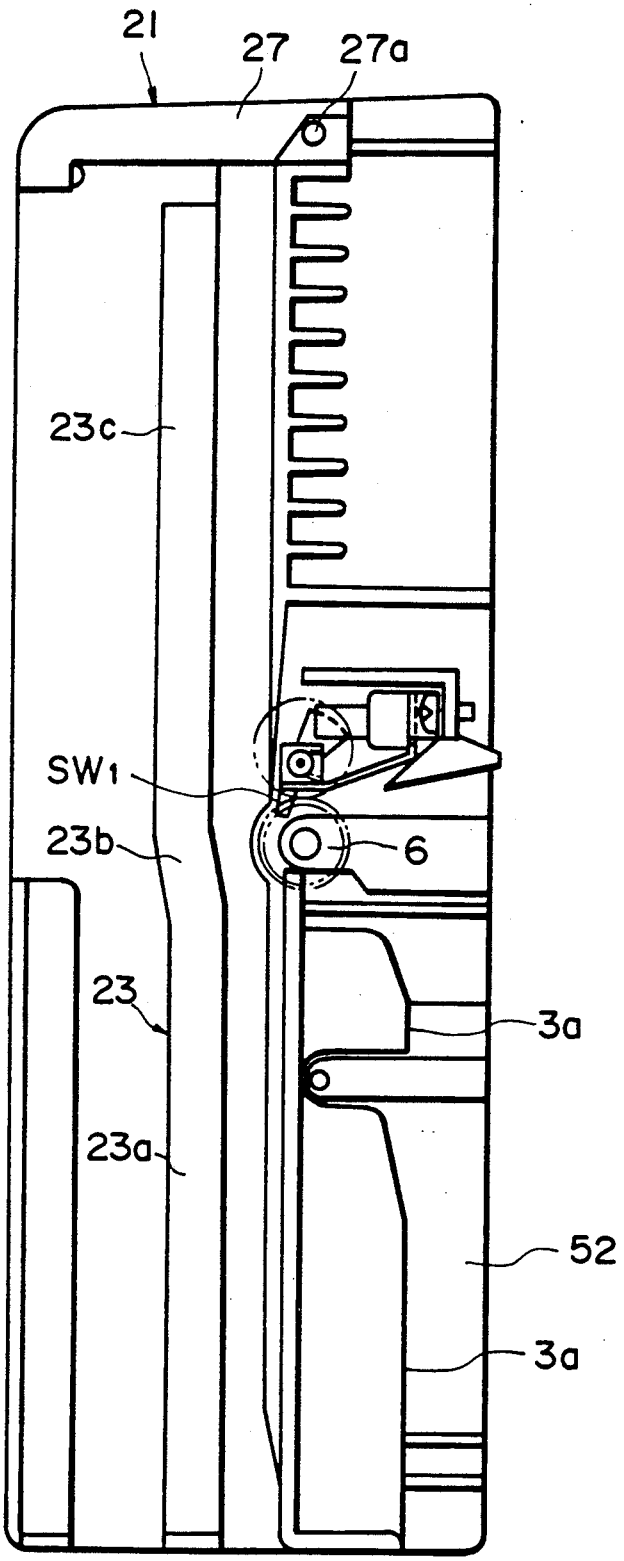
FIG. 3 is a front view illustrating the slot of FIG. 1 sorter.

As shown in FIG. 3, a side wall of each of the posts 21 and 22 is provided with a slot or groove 23 functioning as a guiding slot or groove and including a first portion 23*a* extending vertically toward the neighborhood of the conveying rollers 6, a second portion 23*b* bent away from the conveyance rollers 6 toward an upward direction at about the same level as the conveyance rollers 6 and a third portion 23*c* extending from the second portion 23*b* vertically.

With the slot 23, followers 10*a*, 10*b*–19*a* and 19*b* mounted at each of the lateral sides of the bin trays 10–19 are slidably engaged. The followers 10*a*, 10*b*–19*a* and 19*b* are also engaged with a groove 30 of a supporting frame 24.

The slot 23 is effective to guide the upward and downward movements of the followers 10*a*, 10*b*–19*a* and 19*b* in such a manner that when the bin trays 10–19 move vertically, the leading edges (inlet side edge) of the bin trays are moved substantially along the sheet discharging direction between a position close to the sheet discharge outlet 60 and a position remote therefrom by guiding the followers.

By forming the slot 23 in such a manner, the followers 10*a*, 10*b*–19*a* and 19*b* are moved to the neighborhood of the sheet outlet 60, upon the bin trays receiving the sheets, to displace the leading edge of the bin tray toward downstream of the rollers 6, while to displace them along the bent portion 23*b* away from the sheet discharge outlet 60 upon upward movement of a bin tray after receiving a predetermined number of sheets, thus permitting the upward movement without interference with the rollers 6. Therefore, upon reception of the sheets by bin trays, the sheets discharged by the pair of conveying rollers 6 are assured to be received by the bin trays at its trailing edges.

Referring back to FIG. 2, the posts 21 and 22 are integrally molded of plastic resin material or the like together with the connecting plate 25 connecting the posts 21 and 22. The slots 23 in the posts 21 and 22 and a top cover 26 are simultaneously mold-formed. By doing so, the assembling is very easy, and the assembling accuracy is significantly improved. A movable cover 27 is connected to the top cover 26 of the posts 21 and 22 and is movable about a hinge pin 27*a* in the direction indicated by an arrow in FIG. 1 between an open position and a close position. Therefore, when a bin cover 29 for fixing the bottommost bin tray 19 and the bin slider 28 is lifted to the neighborhood of the bottom edge of the movable cover 27, and when something is sandwiched between the bin cover 29 and the movable cover 27, the movable cover 27 is rotatable in the clockwise direction, and therefore, is retracted. By the provision of the movable cover 27, even if something is sandwiched between the bin cover 29 and the movable cover 27, the movable cover 27 is pushed upwardly and is retracted, and thereafter, an unshown upper limit switch is actuated. Therefore, the cover of the posts 21 and 22 is not damaged, and in addition, the motor or the drive transmission mechanism is not adversely affected.

The supporting frame 24 is provided with an elongated slot 30 in addition to the slot 23, and the supporting frame 24 is substantially vertically movable along the slot 23. On the top of the supporting frame 24 guide followers 31*a* and 31*b* are mounted. Both lateral sides of the bin cover 29 are fixedly mounted to the supporting frame 24 by an unshown screws. Therefore, the bin cover 29 is substantially vertically movable together with the supporting frame 24 without rotation relative to the supporting frame 24. The followers 10*a*, 10*b*–18*a* and 18*b* of the bin trays 10–18 are engaged with the elongated slot 30 of the supporting frame 24 for substantially vertical movement. In this case, the bottommost bin tray 19 is securedly fixed to the supporting frame 24, and therefore, it is movable up and down while supporting the trailing edge of the bin trays 10–18.

Referring back to FIG. 2, the posts 21 and 22 contain single-threaded lead cams 35 having the same pitch, in the form of a helical groove. The lead cams 35 are coupled with and supported on upper portions of vertical rotational shafts 36 and 37. Lower portions of the vertical axes 36 and 37 are provided with drive transmission means 38–40 such as gears or the like and chains (not shown). Through the chains, the driving force is transmitted from a shift motor 41 so that the lead cams 35 can be rotated in forward and backward direction. In the following description, the forward rotation is defined as such a rotation as to raise the bin tray by the lead cams 35.

Figure 4:
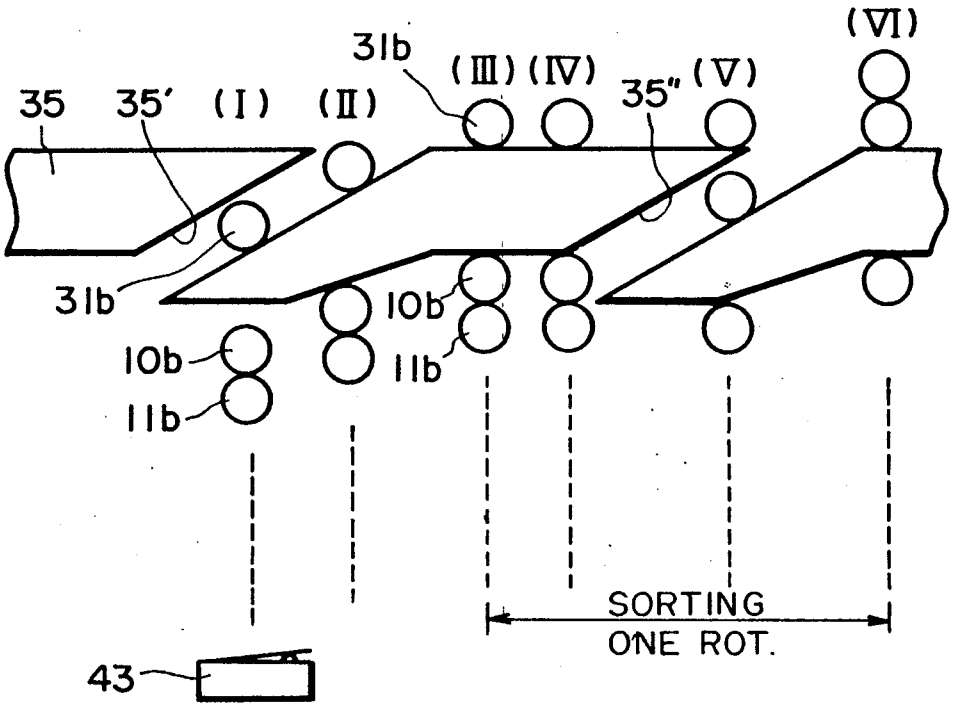
FIG. 4 is a developed view of an outer periphery of the lead cam.

FIG. 4 is a developed view of the lead cam 35, and in this Figure, a track of one forward rotation from a helical groove 35' to a helical groove 35" is shown. When the sorter main assembly 3 being at rest receives instructions from the copying machine or another external signal by operator, the shift motor 41 rotates in its forward direction, by which the supporting frame 24 moves upwardly along the slot 23 together with the leading or inlet side or front edges of the bin trays. In FIG. 4, positions of the followers of the bin trays in FIG. 1 are depicted by (iii). This is a regular stop position (sorting position) of the lead cam 35. Downward movement of the supporting frame 24 is started by backward rotation of the lead cam 35. The guide followers 31*a* and 31*b* receive through the supporting frame 24 the total weight of the bin trays 10–19. Therefore, upon the backward rotation of the lead cam 35, the follower 31*b* is received by the helical groove 35' and is moved downwardly along the helical groove 35'. When the supporting frame 24 lowers together with the bin trays through an amount corresponding to one half rotation of the lead cam 35 while keeping the space between adjacent bins defined by an elongated slot 30 of the supporting frame 24, the supporting frame 24 is brought in contact with a microswitch 43 disposed adjacent the bottom end of the slot 23.

Figure 5:
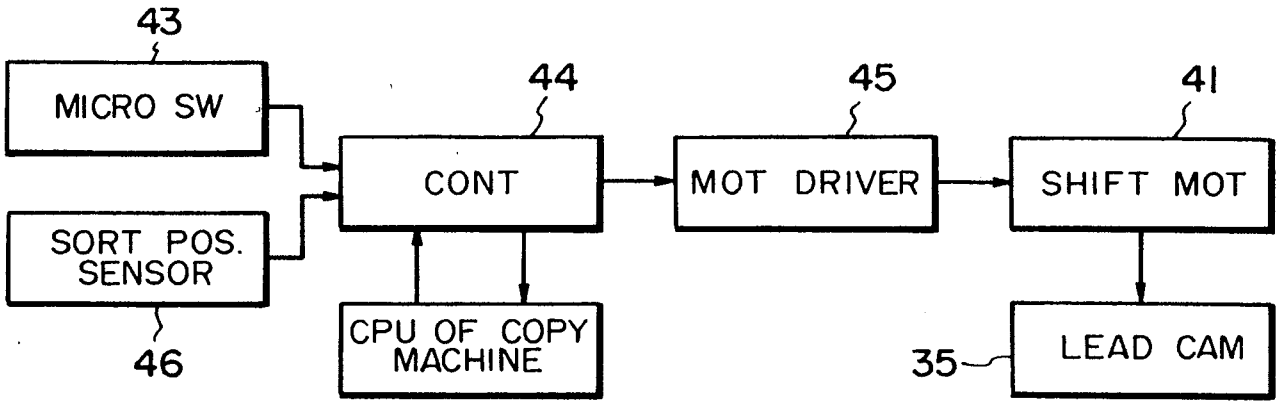
FIG. 5 is a block diagram illustrating a control system for FIG. 1 sorter.

As shown in FIG. 5, the signal produced by the microswitch 43 is supplied to the control circuit 44, which stops the backward rotation of the shift motor 41 through a motor driver 45 so as to stop the rotation of the lead cam 35. With this state, the topmost bin tray 14 is at such a position as to receive the sheets conveyed. This is depicted by (i), and is defined as a non-sorting position. Upon stoppage of the backward rotation, the conveying rollers 6 start to rotate to feed the sheets from the discharging roller 2 to the bin tray 10.

During the non-sorting operation, the supporting frame 24 is controlled such that it lowers through an amount corresponding to one half rotation of the lead cam 35, and therefore, the supporting frame 24 lowers to a position approximately 10 mm lower than the sorting position (FIG. 1). With this state, the bin tray 10 is capable of stacking approximately 100 sheets. If it is lowered through an amount corresponding to one full rotation of the lead cam 35, it lowers through approximately 24 mm, and therefore it lowers too much, although the capacity of 100 sheets is sufficient when the non-sorting position is taken.

During the sorting operation, the lead cam 35 is at the position (iii), and the topmost bin tray 10 receives a predetermined number (approximately 30 sheets) of the conveyed sheets. Subsequently, when a microswitch detects absence of paper (completion of sheet passage) is detected, the rotation of the conveying rollers is stopped, and simultaneously, the shift motor 41 starts the forward rotation. The starting position of the bin tray is as shown in FIG. 4 by (iii). By the forward rotation, a rake portion having an acute angle constituting the bottom end of the helical groove 35" of the lead cam 35 is contacted to the lower circumferential surface of the follower 10*b* to raise it along the helical groove 35". The other bin trays 11–19 are not guided by the helical groove 35" of the helical cam 24, but they are raised together with the supporting frame 24 when the state changes from (v) to the state (vi). At this time, only the follower 10*b* reaches the regular stop position at the upper smooth surface of the lead cam 35, wherein the sort position sensor 46 detects this to stop the forward rotation of the shift motor 41 to stop the lead cam 35. Simultaneously, the conveying rollers 6 which are not moved up to now, start to rotate to feed the sheets to the bin tray 11. In this manner, in the sorting mode, the bin trays move upwardly while receiving the sheets in accordance with the sheet discharge signals, from the topmost bin tray. When a predetermined number of sheets are distributed to each of the bin trays, the reversed sorting operation is effected for the next page or pages. More particularly, the bin trays are lowered while receiving sequentially the sheets in response to the sheet discharge signals.

Figure 6:
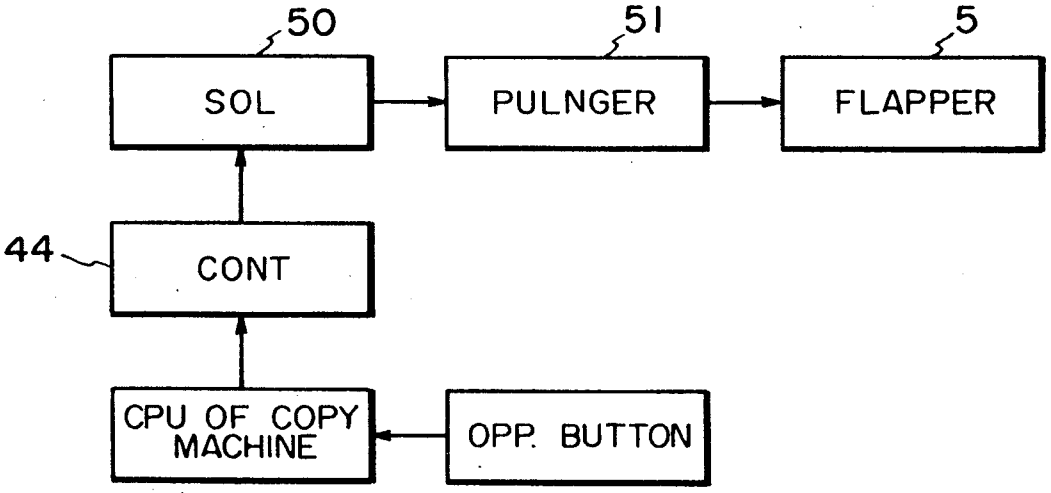
FIG. 6 is a block diagram for operating a flapper of FIG. 1 sorter.

Referring back to FIG. 1, the flapper 5 functions as a conveying guide for feeding the sheet to the pair of conveying rollers 6 during a normal copy mode of the copying machine 1. When a mode is selected wherein the discharged sheet from the copying machine is reversed into the copying machine 1 for duplex or superimposing copy, the flapper 5 is pivoted in the counterclockwise direction by energization of the plunger 51 actuated by an actuating signal to the solenoid 50, as shown in FIG. 6, and the flapper serves to guide the sheet along the guiding groove 52. The guiding groove 52 is formed by a wall 3*a* of the sorter 3 and a side plate 1*e* of the copying machine. The guiding groove 52 is in the form of a substantially vertical cavity at an end surface of the sorter 3. The wall 3*a* is also integrally formed with the posts 21 and 22. Since the guiding groove 52 is not provided with a bottom surface to provide a through opening, and therefore, it can accommodate any size of the sheet.

Figure 7:
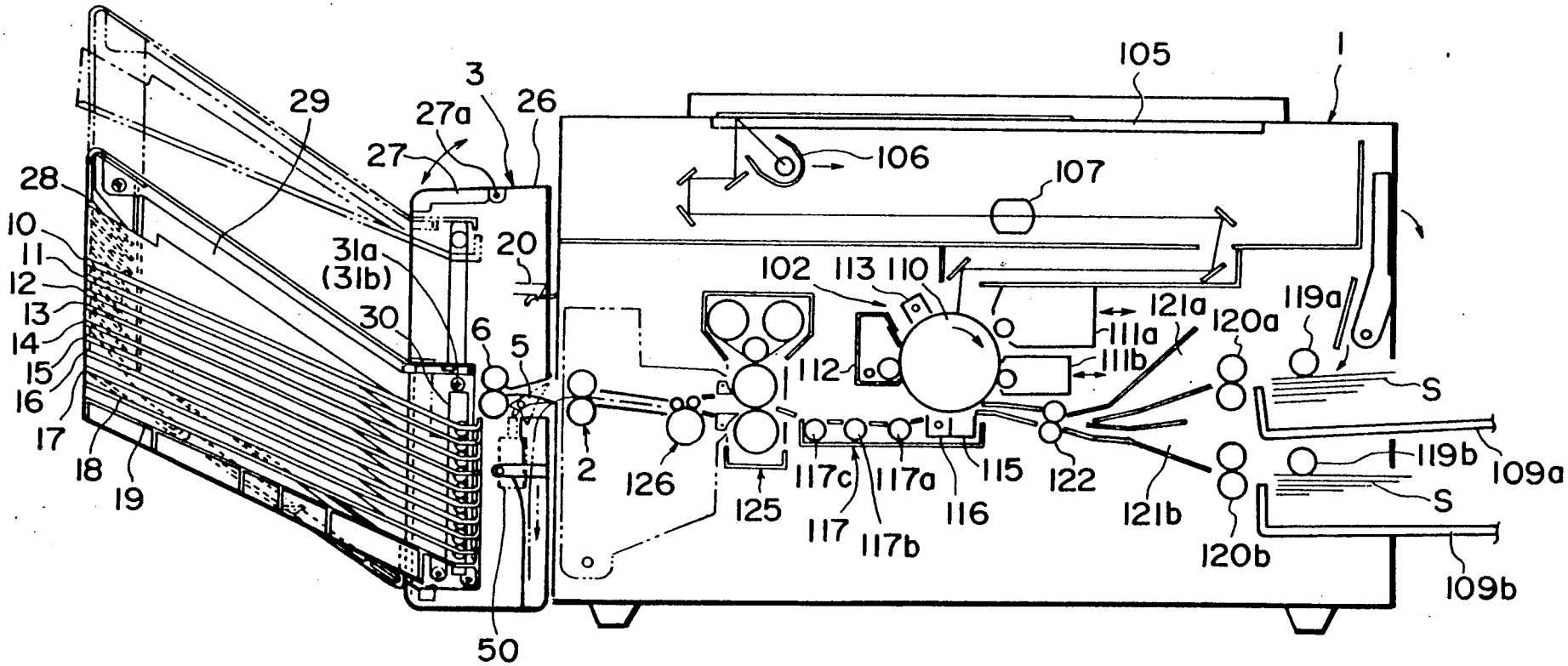
FIG. 7 illustrates the sheet sorter of FIG. 1 used with a typical copying machine.

As shown in FIG. 7, the copying machine 1 contains a copying station 102 and is provided with an original supporting platen 105, a light source 105, a lens system 107, two cassettes 109*a* and 109*b* and others. The copying station 102 is disposed adjacent a center of the copying machine 1 and includes a cylindrical photosensitive member 110. Around the photosensitive drum 110, there are disposed two developing devices 11*a* and 11*b* containing different toner particles, a cleaner 112, a primary charger 113, a transfer charger 115 mounted to an edge portion of a conveying device 117 including conveying rollers 117*a*, 117*b* and 117*c*, and a separation charger 116. Each of the cassettes 109*a* and 109*b* is equipped with a pick-up roller 119*a* or 119*b*, from which a transfer sheet S is conveyed to a couple of registration roller 122 by the conveying rollers 120*a* and 120*b* and through conveying passages 121*a* and 121*b*. When the sorter main assembly is mounted to the copying machine 1 having this structure, the sheet having an image copied by the copying station 102 is discharged by way of an image fixing device 125 by the discharging rollers 2. The discharged sheet is advanced to the conveying roller pair 6 by way of the flapper 5.

Figure 8:
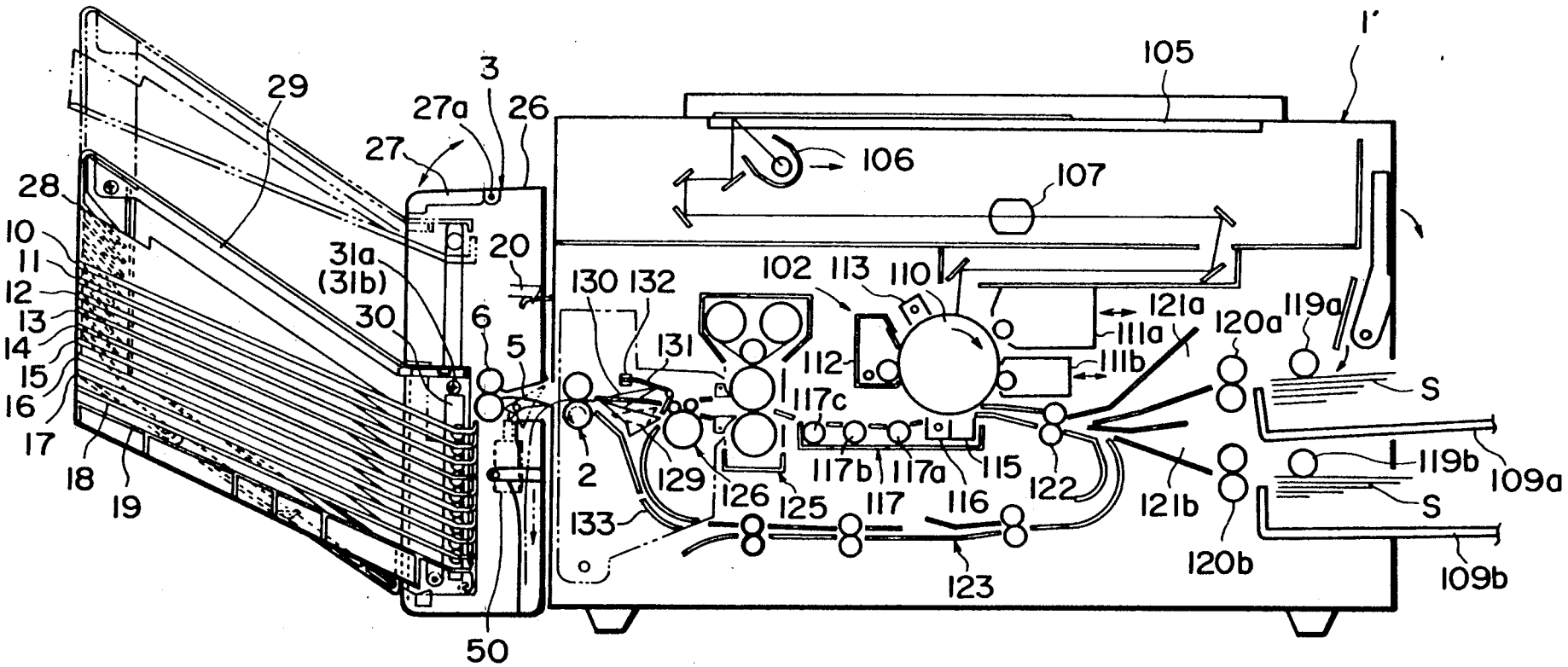
FIG. 8 illustrates FIG. 1 sorter used with a copying machine capable of superimposing and/or duplex copying.

FIG. 8 shows an example wherein the sorter main assembly 3 of this embodiment is mounted to a copying machine 1' capable of duplex and/or superimposing copy. The same reference numerals as in FIG. 7 are assigned to the elements having the corresponding functions, and the detailed description of these elements are omitted for simplicity. In FIG. 8, between the discharging roller pair 126 and the discharging roller pair 2, a flapper 129 and an auxiliary flapper 130 pivoted by an unshown solenoids are disposed. In a lower portion of the copying station 102, there is a sheet conveying portion 123. Through the sheet conveying portion 123, the transfer sheet S which is to be subjected to the superimposing or duplex copying operation is guided to the registration roller pair 122.

In the duplex copying operation, the transfer sheet S is partly discharged outside the machine by the forward rotation of the discharging roller pair 2. At this time, the flapper 5 of the sorter main assembly 3 is shifted to a position indicated by chain lines when a duplex copy is selected by depressing a button in a copying machine, so that the transfer sheet S is guided to the guiding groove 52. Upon departure of the trailing edge of the transfer sheet S from the auxiliary flapper 130, the discharging roller pair 2 is rotated reversely in response to operation of a detecting arm 131 and a photosensor 132, and the transfer sheet S is guided by the auxiliary flapper 130 and a left side portion of the flapper 129 and is introduced into the passage 133. Upon superimposing copy selected, the flapper 129 is shifted to a position shown by broken lines in FIG. 7 by energization of an unshown solenoid, and the transfer sheet discharged from the discharging roller pair is introduced into the passage 133 by the guiding function of the right side of the flapper 129. The sheet sorter and the copying machine are electrically connected by wires or the like.

As described in the foregoing, the flapper 5 in this embodiment functions as a conveyance guide when the sorter main assembly 3 is used with an ordinary copying machine 1 as shown in FIG. 8, and it functions as a reverse passage mechanism when the sorter main assembly 3 is used with a copying machine 1' capable of duplex or superimposing copy.

While the invention has been described with reference to the structures disclosed herein, it is not confined to the details set forth and this application is intended to cover such modifications or changes as may come within the purposes of the improvements or the scope of the following claims.

What is claimed is:

1. A sheet sorter, comprising:

a plurality of bin trays arranged in the form of multi-stage trays;

a plurality of followers provided on said bin trays adjacent sheet receiving sides of said bin trays; and rotatable means for sequentially moving said followers to expand a gap between adjacent bin trays;

wherein an accommodating portion is provided with substantially vertical independent spaces which are disposed at respective sides of the sheet receiving side of said sheet sorter and which are defined by walls to accommodate said rotatable means, wherein said walls, a vertically and laterally long connecting member for connecting the walls at the respective sides and members for defining grooves for guiding movements of the plurality of followers, are integrally molded, and wherein the members for defining the grooves are parts of such portions of the walls from which the connecting member is extended.

2. A sorter according to claim 1, wherein said rotatable means is a helical cam means provided with a helical groove for guiding said followers.

3. A sorter according to claim 1, further comprising a rotatable member, disposed adjacent the sheet receiving side, for guiding the sheets to said bin trays, a sheet passage disposed upstream of said rotatable member with respect to a direction of movement of the sheet, and switching and guiding means, disposed upstream side of said rotatable member, movable between a position wherein it directs the sheet to said rotatable member and a position wherein it directs the sheet to said sheet passage.

4. A sorter according to claim 3, wherein said switching and guiding means also functions as a guide for guiding the sheet to said rotatable member.

5. A sorter according to claim 3, wherein the sheet passage extends substantially downwardly.

6. A sorter according to claim 5, wherein said sheet passage is defined by a recess.

7. A sheet sorter, comprising:

a plurality of bin trays arranged in the form of multi-stage trays;

a plurality of followers provided on said bin trays adjacent sheet receiving sides of said bin trays;

rotational means for moving sequentially said followers to expand a gap between adjacent bin trays;

a rotatable member, disposed adjacent a sheet receiving side of said bin trays, for guiding the sheets to said bin trays;

a sheet passage, disposed upstream of said rotatable member with respect to a direction of movement of the sheet, for guiding the sheet substantially in a vertical direction, said sheet passage being constituted by a guiding member for guiding one side surface of the sheet and being open to outside of said sorter at a bottom thereof and at a side faced to said guiding member; and switching and guiding means, disposed upstream of said rotatable member, movable between a position wherein it directs the sheet to said rotatable member and a position wherein it directs the sheet to said sheet passage.

8. A sorter according to claim 7, wherein said switching and guiding means also functions as a guide for guiding the sheet to said rotatable member.

9. A sorter according to claim 7, wherein the sheet passage extends substantially downwardly.

10. A sorter according to claim 9, wherein said sheet passage is defined by a recess.

11. An image forming apparatus, comprising:

a discharging rotatable member for discharging a sheet having an image; and a sheet sorter including;

a plurality of bin trays arranged in the form of multi-stage trays;

a plurality of followers provided on said bin trays adjacent sheet receiving sides of said bin trays; and rotatable means for sequentially moving said followers to expand a gap between adjacent bin trays;

wherein accommodating portion disposed at both sides of the sheet receiving side of said sheet sorter to accommodate said rotatable means, a connecting portion for connecting said accommodating portions and a member for defining a groove for guiding movements of the plurality of followers, are integrally molded.

12. A sorter according to claim 11, further comprising a rotatable member, disposed adjacent the sheet receiving side, for guiding the sheets to said bin trays, a sheet passage disposed upstream of said rotatable member in a direction of movement of the sheet, and switching and guiding means, disposed upstream side of said rotatable member, movable between a position wherein it directs the sheet to said rotatable member and a position wherein it directs the sheet to said sheet passage.

13. An image forming apparatus, comprising:

discharging rotatable means including rollers capable of rotating in opposite directions for discharging a sheet having an image; and a sheet sorter, including:

a plurality of bin trays arrange din the form of multi-stage trays;

a plurality of followers provided on said bin trays adjacent sheet receiving sides of said bin trays;

rotational means for moving sequentially said followers to expand a gap between adjacent bin trays;

a rotatable member, disposed adjacent the sheet receiving side, for guiding the sheets to said bin trays;

a sheet passage disposed upstream of said rotatable member with respect to a direction of movement of the sheet, for guiding the sheet substantially in a vertical direction, said sheet passage being constituted by a guiding member for guiding one side surface of the sheet and being open to outside of said apparatus, at a bottom thereof and at a side faced to said guiding member;

a re-feeding passage for conveying a sheet on which in image has been formed to form a further image; and switching and guiding means, disposed upstream of said rotatable member, movable between a position wherein it directs the sheet to said rotatable member and a position wherein it directs the sheet to said sheet passage.

14. An apparatus according to claim 13, wherein said sheet sorter is retractable.

* * * * *

UNITED STATES PATENT AND TRADEMARK OFFICE

CERTIFICATE OF CORRECTION

PATENT NO. : 5,050,860

DATED : September 24, 1991

INVENTOR(S) : Kazuhiro Matsuo, et al.

It is certified that error appears in the above-identified patent and that said Letters Patent is hereby corrected as shown below:

IN THE DRAWINGS

SHEET 5:

In Fig. 6, "PULNGER" should read --PLUNGER--.

COLUMN 2:

Line 31, "sorting" should be deleted.

COLUMN 8:

Line 45, "including;" should read --including:--; and

Line 53, "portion" should read --portions--.

COLUMN 9:

Line 6, "arrange din" should read --arranged in--.

COLUMN 10:

Line 7, "in" should read --an--.

Signed and Sealed this

Eighth Day of June, 1993

*Attest:*

*Attesting Officer*

Michael K. Kirk

MICHAEL K. KIRK

*Acting Commissioner of Patents and Trademarks*